United States Patent [19]

Dieringer et al.

[11] 3,964,397

[45] June 22, 1976

[54] RAILROAD TIE HANDLING MACHINE AND METHOD

[75] Inventors: Andrew M. Dieringer, Waterford; Gunars Eidemanis, Milwaukee, both of Wis.

[73] Assignee: Rexnord Inc., Milwaukee, Wis.

[22] Filed: Aug. 5, 1974

[21] Appl. No.: 494,611

Related U.S. Application Data

[63] Continuation of Ser. No. 131,128, April 5, 1971, abandoned.

[52] U.S. Cl. ..... 104/9

[51] Int. Cl.[2] ..... E01B 29/10

[58] Field of Search ..... 104/6, 9; 254/43, 44; 37/104

[56] References Cited

UNITED STATES PATENTS 2,923,253 2/1960 Geier et al. ..... 104/9

3,698,324 10/1972 Peppin et al. ..... 104/9

*Primary Examiner*—M. H. Wood, Jr.
*Assistant Examiner*—Richard A. Bertsch
*Attorney, Agent, or Firm*—Kinzer, Plyer, Dorn & McEachran

[57] ABSTRACT

This is a method of and apparatus for forming a trench in the ballast under railroad track, commonly referred to as scarifying, and for grasping new ties, one at a time, positioned on top of the rails, drawing each tie in turn out to one side, positioning it opposite the trench and inserting it, all in a series of coordinated movements in sequence with a minimum, if any, disturbance of the ballast.

35 Claims, 14 Drawing Figures

INVENTORS.
ANDREW M. DIERINGER
GUNARS EIDEMANIS
BY Parker, Carter & Markey
Attorneys.

38
32
18
140
10
30
145
144
14
42
44
48
20
143
4
154
64
58
63
74
56
68
71
72
70
52
153
24
22
151
40
152
46
12
26
138
106
108
110
98
94
96
136
80
76
84
83
112
86
116
118
172
92

66
68
52
66
68
69
44
64
64
63
PS1
58
61
71
61
70
70
62
56
72
74
46
18

RAILROAD TIE HANDLING MACHINE AND METHOD

This is a continuation of Ser. No. 131,128, filed Apr. 5, 1971, now abandoned.

SUMMARY OF THE INVENTION

This invention is in the field of devices for inserting new ties under the rails of existing railroad track and is concerned with a method and apparatus for inserting new ties under the rails with a minimum disturbance of the existing ballast so the track will not be humped or misaligned.

A primary object of the invention is a scarifier-inserter and method which requires only one operator.

Another object is a method and apparatus of the above type in which as many, if not most, of the complex motions required to be performed by the machine are accomplished automatically with a minimum of operator control.

Another object is a method and apparatus for inserting new ties in which the ties are initially positioned on top of the rails and are thereafter moved outwardly, aligned with an opening or trench under the rails and inserted with the path and movements between being automatically controlled and coordinated.

Another object is a scarifier-inserter which, due to the path followed by the new tie, can be used to insert the tie from either side.

Another object is a method and apparatus of the above type in which the tie enters under the rail at an angle to the crib surface for easiest entry avoiding hangups on the base of the rail.

Another object is a method and apparatus of the above type whereby a high shoulder next to the track will not interfere with tie insertion due to the coordinate path that the machine automatically applies to a new tie.

Another object is a method of handling and inserting new ties in railroad track in which only one end of the tie is grasped.

Another object is an automatic scarifier-inserter in which the tie insertion mechanism is only energized after the scarifying mechanism has formed a trench.

Another object is a scarifier-inserter of the above type in which the insertion mechanism is automatically energized in response to the machine contacting a new tie positioned on top of the rails.

Another object is a scarifier in which vertically movable blades are constructed to penetrate the ballast and to be separated to form a trench therebetween and are arranged so that the blades will be automatically separated when they have penetrated the ballast to a predetermined extent and will be automatically raised if they have not penetrated the ballast to the predetermined extent.

Another object is a machine of the above type with an insertion mechanism which is automatically energized to insert a new tie when the blades have been separated.

Another object is a machine of the above type in which the blades will be automatically raised and closed in response to complete insertion of a new tie by the insertion mechanism.

Other objects will appear from time to time in the ensuing specifications and drawings:

DESCRIPTION OF THE PREFERRED EMBODIMENT

Figure 1:
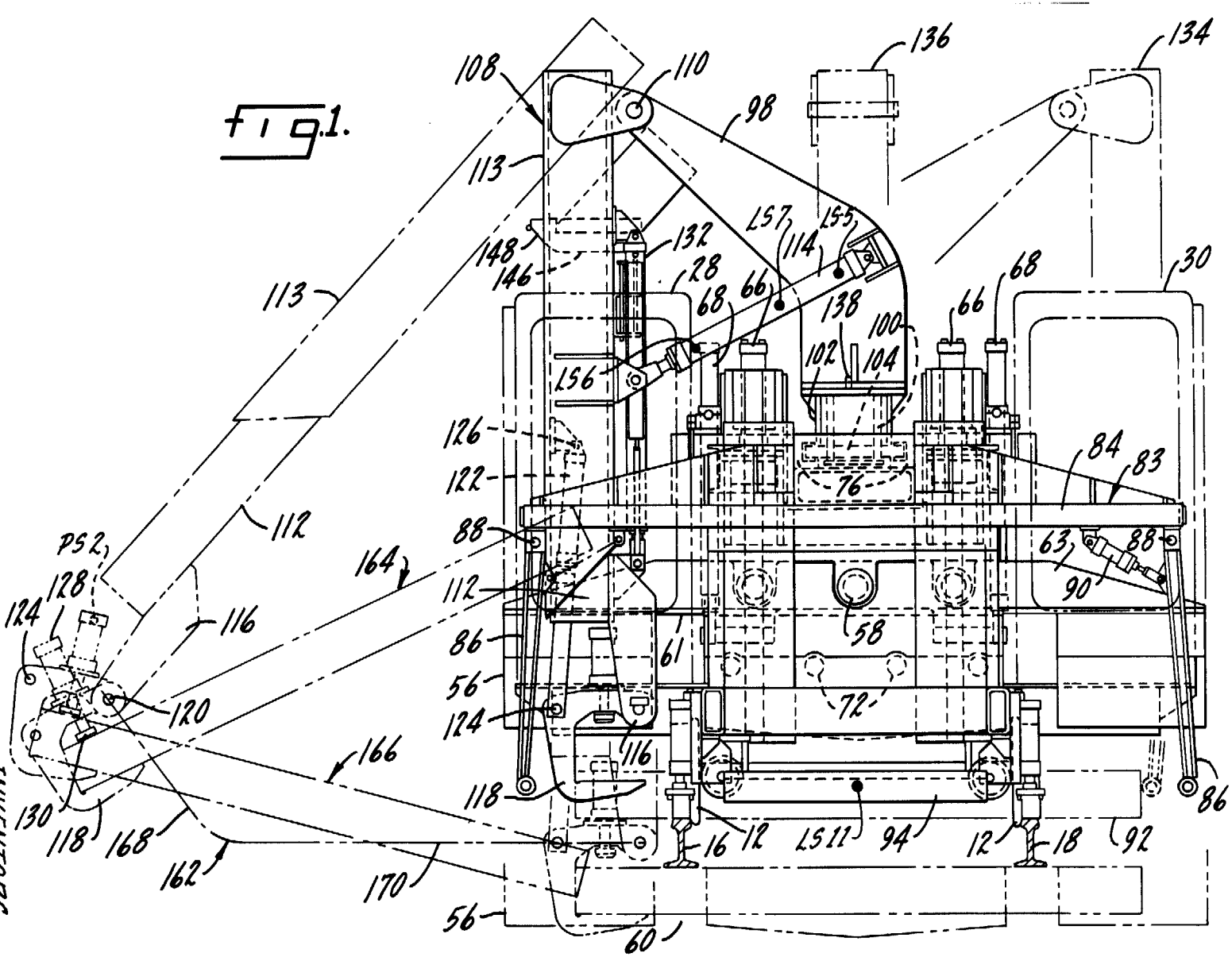
FIG. 1 is a front view of the machine showing several positions of the various parts in broken lines.
Figure 2:
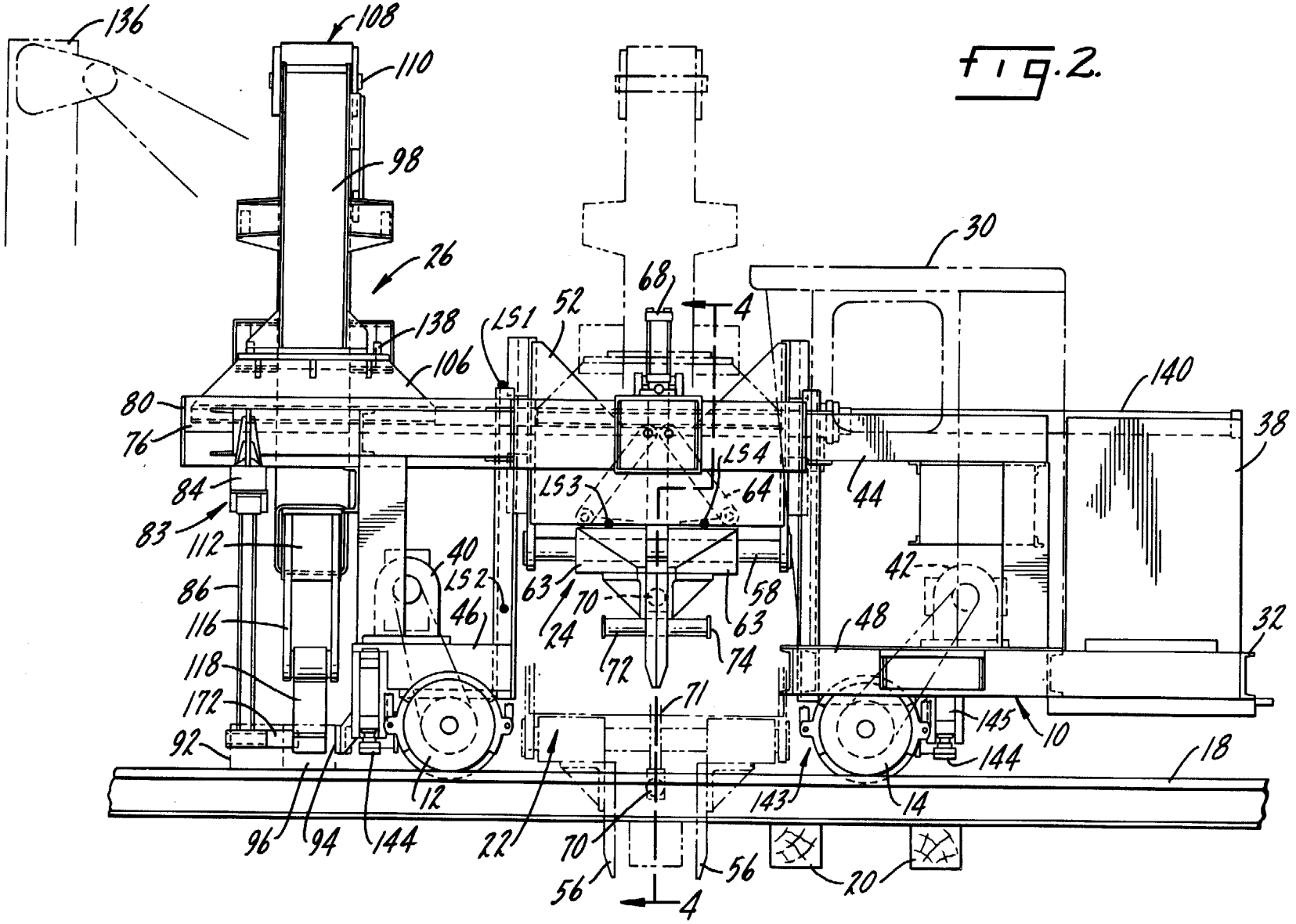
FIG. 2 is a side view of FIG. 1 with several broken line showings of various positions.
Figure 3:
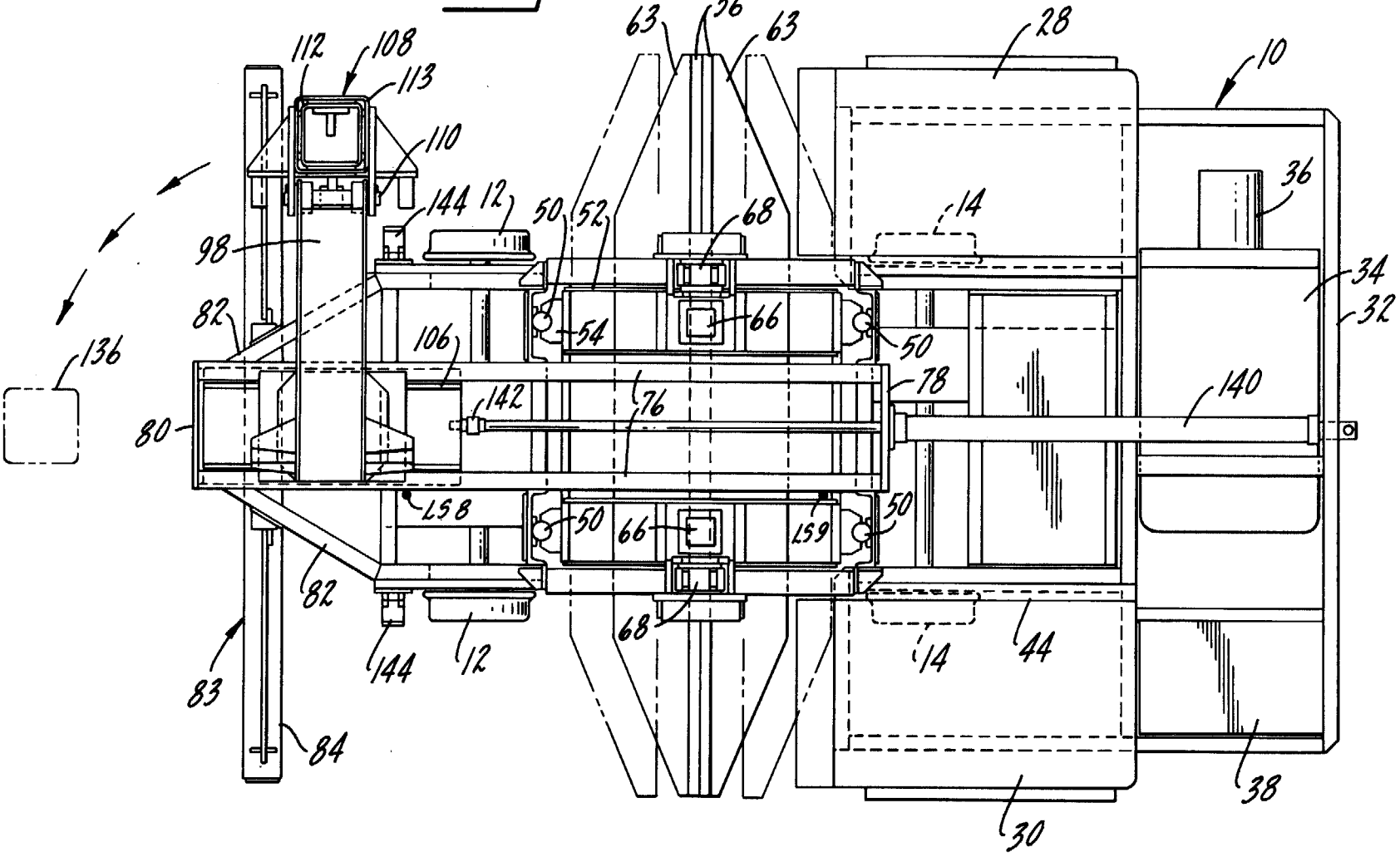
FIG. 3 is a top view of FIG. 2.

In FIGS. 1, 2 and 3 the machine is shown as including a frame, indicated generally at 10, with front and rear conventional flanged wheels 12 and 14 resting on the railroad track which includes rails 16 and 18 on ties 20. In the operative position of the various parts in FIG. 1, and as explained in detail hereinafter, it will be noted that the new ties are inserted from the left side in FIG. 1 which is the right side of the machine. So rail 16 shall be referred to as the near rail and rail 18 as the far rail. The frame has a center opening 22 where a scarifying mechanism, generally designated 24, is located. A tie inserter mechanism, indicated generally at 26, is positioned on what may be considered the forward part of the machine. Two operator cabs 28 and 30, one on each side, are positioned on what may be considered the rear part of the frame. A frame extension 32 on the rear of the machine may support a power source 34, such as a diesel or gasoline engine, to drive a hydraulic pump 36 or the like which supplies pressure fluid for the various operative parts, described hereinafter. A reservoir tank 38 for hydraulic oil may also be supported by the frame extension. The front and rear axles for the wheels 12 and 14 may be driven by hydraulic motors 40 and 42, as shown in FIG. 2.

The center opening 22 of the frame takes the form of a passageway extending laterally through the frame with the upper part 44 of the main frame being in the form of a box and structurally complete while the lower part is separated and may be considered to be two somewhat smaller boxes or frames 46 and 48.

The scarifying mechanism 24 is in the nature of a drop head arrangement much like what is described and shown in prior U.S. Pat. No. 3,294,033, issued Dec. 27, 1966 and assigned to the present assignee. The upper box-type frame 44 supports four vertical slides or rounds 50, in FIG. 3. A drop head 52 is supported within the rounds with bearings or blocks 54 opposite each round and bearing against it. The blocks 54 have a half-round channel bearing against the slides so that as the drop head falls the four rounds fixed on the frame will guide and control the free-fall of the drop head 52.

Figure 4:
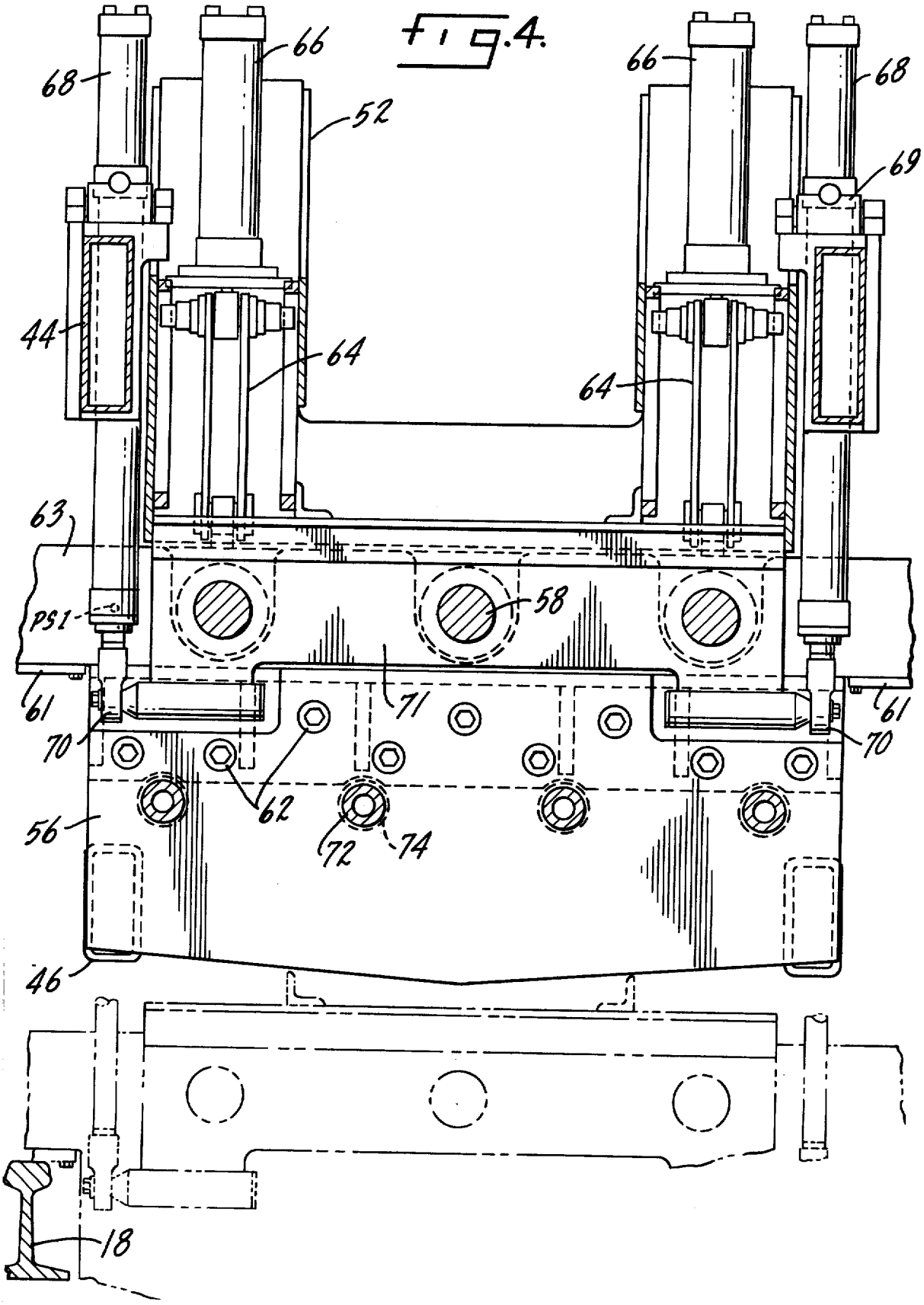
FIG. 4 is a section along line 4—4 of FIG. 2, on an enlarged scale.

The drop head has cofferdams or blades 56 on the bottom portion thereof directed downwardly and mounted on slide rods 58, shown in this case as, 3, so that the blades may be brought together in what may be thought of as a closed position, as shown in the raised position of the drop head in FIG. 2, and may be separated in what may be thought of as an open position, as shown in the broken-line lower position in FIG. 2. The blades may be thought of as cofferdams which extend across the rails and outwardly an appropriate distance on each side thereof. Note in FIG. 1 that the blades have slots or notches 60 which are aligned with and dimensioned to receive the rails so that when the blades are dropped, the sections of the blades will straddle the rails. As shown in FIGS. 1 and 4, the slots may have bearing pads 61 of rubber or the like, if desired, to cushion any contact with the rails. The structure of the blades may be the same as or similar to what is in prior U.S. Pat. No. 3,294,033. For example, the blades are removably mounted by bolts 62, shown in FIG. 4, and extend downwardly from slides or sleeves 63 which slide on the rods 58 and are moved back and forth by links 64 as actuated by piston and cylinder assemblies 66, which are mounted on top of the drop head and ride up and down, two such cylinders being shown in this case, one on each side in FIG. 3. The drop head is raised by two piston and cylinder assemblies 68, one on each side, mounted on the upper frame 44 on each side by a double trunnion 69, as shown in FIG. 4, so that the cylinders can pivot somewhat both longitudinally and laterally. The piston rod of these cylinders connects to the drop head by ball joints 70 on a main crosspiece 71. The stroke is such that the drop head and cofferdams or blades can be freely dropped and will penetrate a sufficient distance into the ballast such that, when they are separated, as shown in broken-lines in FIG. 2, a new tie can be inserted into the trench between the blades. The blades or cofferdams may carry tubes or sleeves 72 at spaced intervals which extend through openings in the blades with flanges 74 on each end so that the tubes won't fall out. Four such tubes are shown in this case in FIG. 1, spaced at suitable intervals and positioned in the center portion of the blades or cofferdams between the rails. Depending upon ballast conditions and other factors, these tubes 72 may not be necessary.

The upper frame 44 carries opposed tracks or channels 76 which are in the nature of spaced, U-shaped channels opening toward each other and extending from a position between the cabs 28 and 30 at a crosspiece or stop 78 to the front where a crosspiece or stop 80 overhangs the front of the machine frame. The overhang may be suitably braced as at 82. The channels 76 serve as a track or slideway for the tie-inserter structure 26 so that it may be moved back and forth between the full- and broken-line positions shown in FIG. 2. The details of the inserter structure will be explained hereinafter.

A tie positioning structure 83 is connected to and depends from the front of the frame and includes a crosspiece 84, suitably braced as shown in the drawings, and of sufficient lateral extent so that it overhangs each side of the frame by a certain amount, shown in FIG. 1. An arm 86 is pivoted at 88 upon each end thereof and is operated by a cylinder 90, only one of which is shown, so that they move between the full- and broken-line positions shown in FIG. 1.

New ties, indicated in phantom at 92 in FIG. 2 are initially placed on top of the rails and, since the positioning is somewhat random, the ends of the ties won't be lined up or even. As the machine moves along the track from right to left in FIG. 2, the arms will first arrive opposite a new tie, note the position of the tie in phantom designated 92 in FIG. 2. With the arms pivoted out, to the full-line position of FIG. 1, the bumpers will beyond the ends of the ties. Then the cylinders 90 retract which moves the arms in and either one bumper or the other, depending upon the position of the tie, will hit the tie and move it either left or right in FIG. 1. The result is that the new tie will be accurately positioned when a contact plate or bumper 94 on the front end of the machine hits the tie. The tie in phantom, designated 92 in FIG. 2, is within the bumpers and is being centered. The machine next moves forward so that the tie occupies the position designated 96 in FIG. 2 which is the pickup position where the inserter, designated generally 26 in full in FIG. 2, will grasp the end of the tie, move it out to the left in FIG. 1, manipulate it in a manner explained hereinafter, and insert it under the rails between the cofferdams 56 in the position of FIG. 2. Operation of the kicker cylinders 90 may be automatic, as explained hereinafter.

Figure 7:
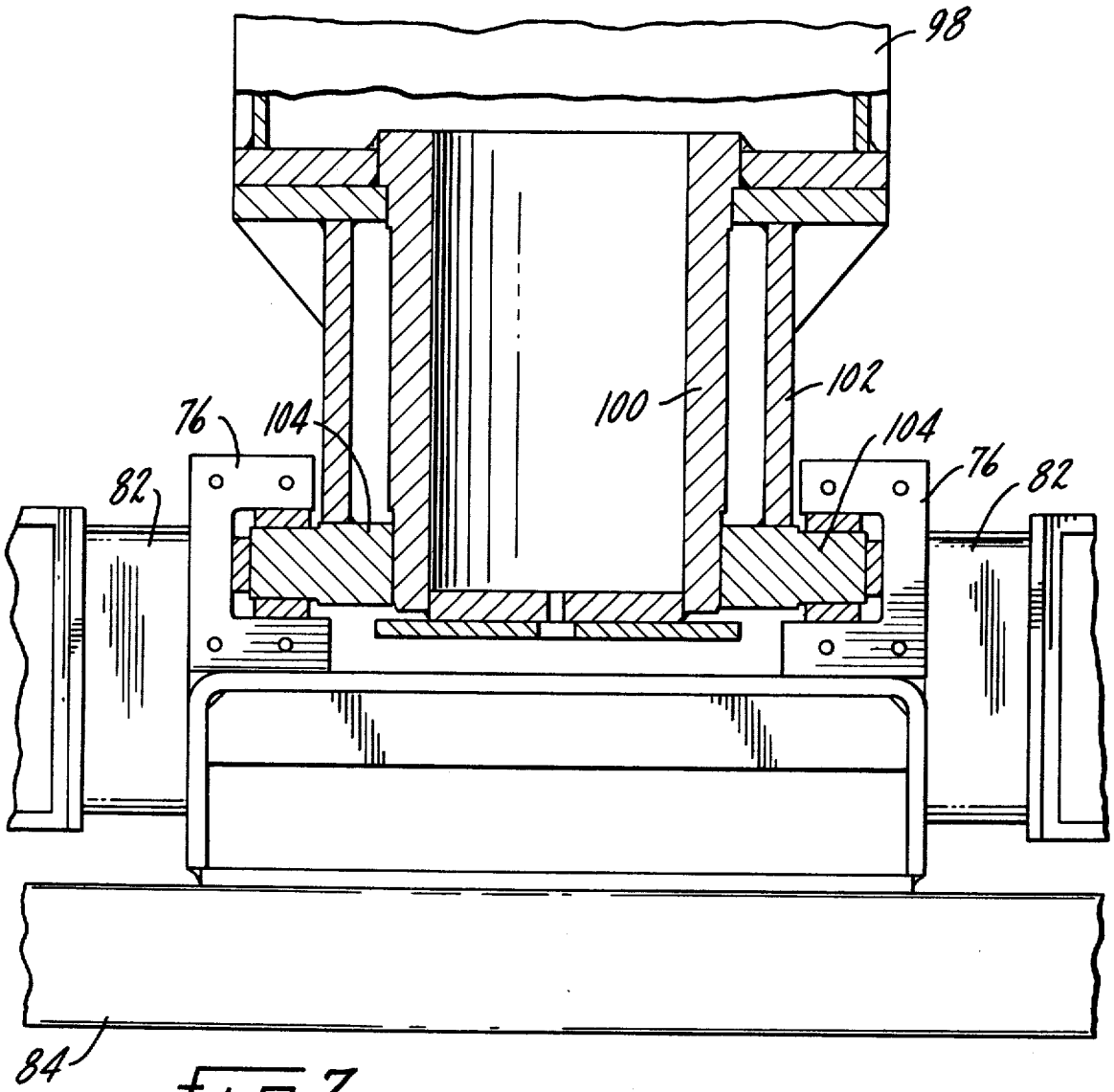
FIG. 7 is an enlargement of a part of FIG. 1, partially in section.

The inserter mechanism 26 includes a mast 98 pivoted about a vertical axis by a suitable sleeve joint 100 to a slide 102, shown in FIG. 7. This slide is dovetailed at 104 and fits in the channels 76 on the frame. Note the extensions 106 in FIG. 2 both front and rear on the slide so that the length of engagement between the dovetails and the channels 76 is substantial. This is to counteract the bending moment or torque applied thereto due to the handling of the tie on either one side or the other of the machine. The mast is bent to one side and has a boom 108 pivoted at 110 toward the upper end thereof. The boom is in two telescoped sections with the lower part 112 slidably mounted inside of the upper part 113. The boom is pivoted by suitable cylinders 114 suitably connected between the mast and boom, one on each side so that the boom can be moved between the full- and broken-line positions in FIG. 1. The lower end 112 of the boom has an extension 116 with a claw or hook 118 pivoted thereto at 120. The hook is tilted by a cylinder 122 connected at one end, as at 124, to a part of the hook and at its other end, as at 126, up inside the boom 112. A jaw clamp cylinder 128 is mounted on the clamp with piston 130 adapted, upon excursion, to clamp one end of a new tie in the claw. The telescopic boom sections are extended and retracted by one or more suitable cylinders 132 mounted on the side thereof.

The entire inserting mechanism 26 can be pivoted on slide 102. For example, the boom is shown operating on the right side of the machine in the drawing but it can be pivoted to operate on the left side, in the broken-line position 134 in FIG. 1. Or it can be positioned straight ahead, as at 136, for traveling. When in any one of these positions, it can be held in place by removable pins at 138, in FIG. 2, positioned in aligned holes in the flanges of the slide and mast. The holes could be put at any suitable intervals so that the mast may be held in any position desired.

A cylinder 140, in FIG. 3, may be connected at 141 to the rear extension of the frame with its piston rod extending through the rear stop 78 of the track and connected at its front end by a universal or swivel joint 142 to the base or slide 102 of the mast. When the piston rod is extended, the boom and tie handling mechanism 26 will be in the full-line position of FIGS. 2 and 3, and when the piston rod is retracted, the boom will be drawn back to the broken-line position of FIG. 2, in which the boom and tie-inserting mechanism will be in the same general lateral plane as the drop head and sacrifying blades. A power mechanism might be provided to rotate the mast and boom from one position to another for working on the left side, right side, or straight ahead for traveling. but since the mast and boom will normally stay in a fixed position for several days between changes, a power source and automatic rotating mechanism is not considered necessary. In the arrangement shown this could be accomplished simply by removing the pins 138 so that the boom will be free for rotation, then wrapping a chain partially around the boom and connecting one end to the mast and the other end to a part of the slide or frame. Then the entire boom, mast and slide could be moved along the guideways by the cylinder 140 which, due to the chain or cable, would cause the mast to rotate.

Each wheel may have a brake and brake cylinder, indicated generally at 143. A setoff mechanism has been indicated generally at 144, one by each wheel with a power cylinder 145 for each. But since this may be conventional, no additional details are considered necessary.

In operation the machine will approach a tie freely-positioned on top of the rails. The arms 86 shove the tie one way or the other laterally so that it is in proper position to be grabbed by the jaw clamp. The unit would then move forward until the tie was in the position designated generally 96 engaging the bumper 94. The inserting mechanism 26 would be in the forward position and the jaw would swing in, grab one end of the tie (the left end in FIG. 1), move out and extend to the broken-line position in FIG. 1 with the tie held by only one end. The jaw 118 would then pivot the tie up, from the 166 position to the 164 position. The mast would then slide rearwardly until it was in the broken-line position in FIG. 2. At this point, the inner end of the tie would be aligned with the trench defined between scarifying blades 56 and the boom would pivot in and retract to force the tie under the rails in the open trench. The unit is also provided with a mechanism for controlling quite accurately the inserting motion of the tie so that both the inner and outer ends of the tie follow a defined coordinated predetermined path which may be referred to as the desired path.

Figure 5:
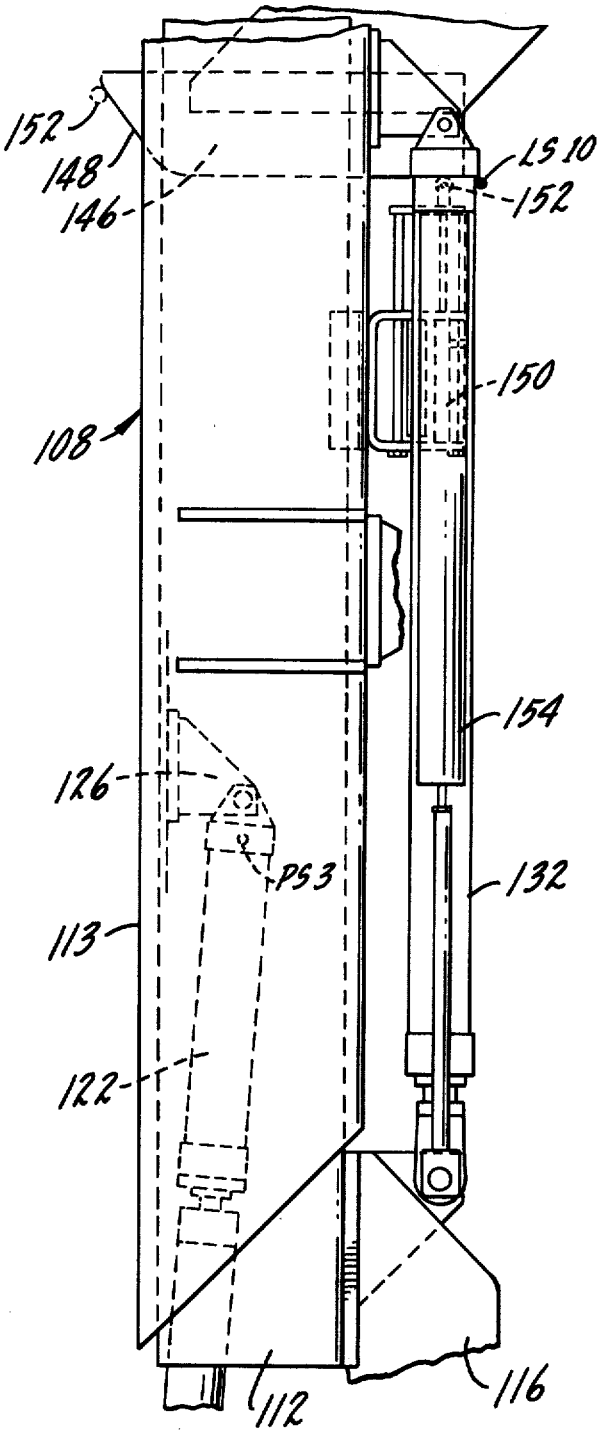
FIG. 5 is an enlargement of a part of FIG. 1.
Figure 6:
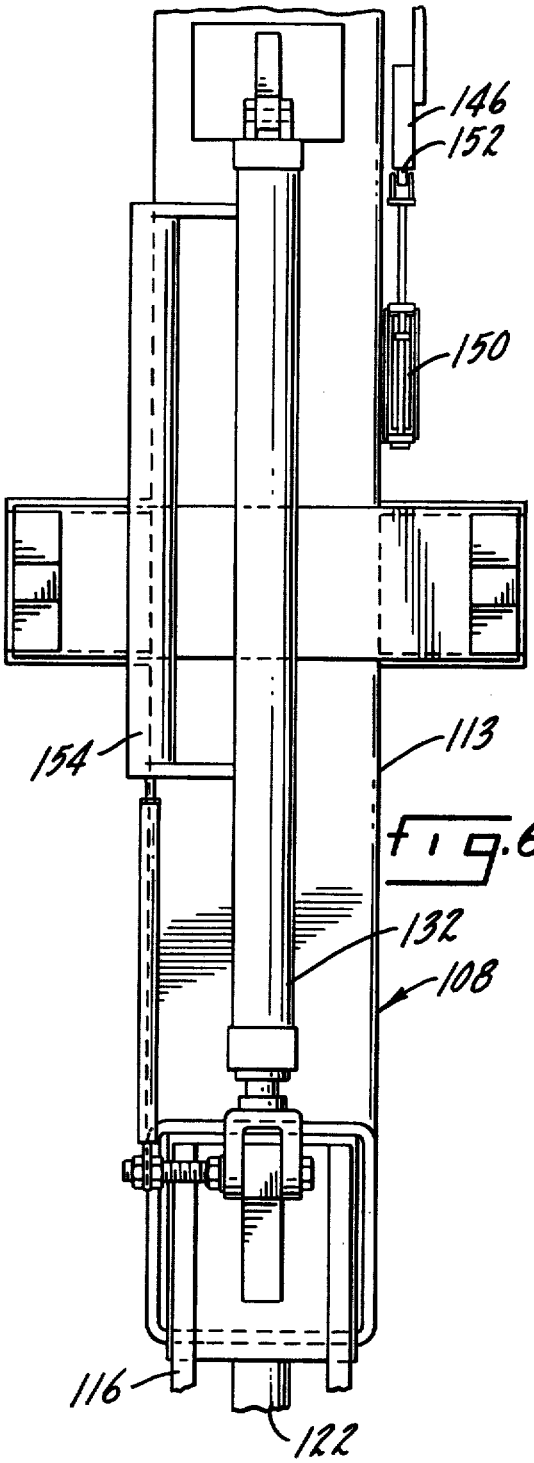
FIG. 6 is a side view of FIG. 5.
Figure 8:
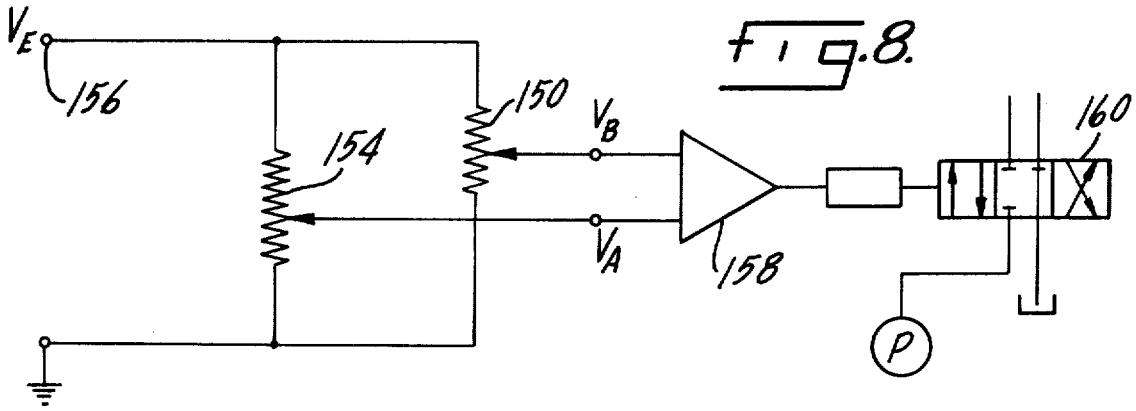
FIG. 8 is a partial wiring and hydraulic diagram.

In FIG. 8 I have shown a simplified schematic of the control for the inserting mechanism 26 which insures that the tie will be inserted along a predetermined path. In FIGS. 5 and 6 a cam 146 is mounted on the mast 98 and has a face or profile 148 which is specifically cut or planned according to the desired pattern. A potentiometer 150 on the boom 108 has a follower 152 whcih is spring biased against the cam profile so that as the boom 108 pivots at 110 about the mast, either in or out, the follower will move along the profile 148 thus changing the resistance of the potentiometer 150. A second potentiometer 154 straddles the piston and cylinder assembly 132 so that as the boom is telescoped in or out the resistance of potentiometer 154 will change and, in effect, will indicate the telescoped position of the boom. As schematically shown in FIG. 8, the two potentiometers are connected across a source 156 with a tap on each running to an amplifier 158. The arrangement is such that, as the boom 108 is pivoted by the cylinders 114 causing movement of cam follower 152 along the cam profile, the setting of potentiometer 150 will be changed which will cause an unbalance between potentiometers 150 and 154 resulting in a current to amplifier 158 which, when amplified, produces a signal to control a hydraulic valve 160. Hydraulic valve 160 controls cylinder 132 which telescopes the boom 108 either in or out. The control of valve 160 is such that the unbalance between the ptentiometers that results in the electric signal will operate cylinder potentiometers so that the boom telescopes in a direction to change the setting on potentiometer 154 toward a balance with potentiometer 150. In short, the circuit insures that the boom telescopes or homes in on a balanced position. Pivoting of the boom on the end of the mast by power cylinders 114 which can be controlled by the operator, or automatically, determines the setting potentiometer 150 which, in turn, creates the unbalance which, in turn, operates the power cylinder 132 to change the telescope position of the boom. So the cam profile 148 controls the boom extension. Thus, by properly profiling the cam face 148 the position of pivot 120 at the end of the boom can be accurately preset in accordance with each and every pivoted position of the boom. Thus the cam profile 148 can be accurately reproduced at the path of point 120. In FIG. 1 the path of point 120 has been indicated in broken lines at 162 and it will be noted that it duplicates the profile of cam face 148. The precise path shown will be explained hereinafter.

A full diagram for the hydraulics and circuitry will be set forth and explained hereinafter in connection with FIGS. 9 and 10*a–e* with possibly some duplication and overlap with FIG. 8. This is to say that FIG. 8 is a simplified explanatory schematic and is included merely for purposes of explaining the function and operation of the cam face and follower and the effect thereof upon tie insertion. In that sense, FIG. 8 is not intended to be or to represent a full wiring diagram or hydraulic circuit but rather is more in the nature of a simplified sketch put in at this point for purposes of explanation.

Assume that the machine is generally in position to insert a tie. The drop head 24 is "up" ready to be dropped, and the boom and mast are in the rear position (broken lines in FIG. 2) with a new tie in the clamp 118, the boom is extended (broken lines in FIG. 1) and with the inner end of the tie tilted up so that the new tie is in the position indicated at 164 in FIG. 1. The operator would be in the righthand cab 28, on the side where the machine is working, so that he can view and control the operation. In this position, the operator then would initiate the following movements either manually or automatically.

First, the drop head would be dropped — a free fall —so that the blades 56 would embed themselves in the ballast. The drop head should be heavy enough so that it will drive the blades down far enough to form a trench of sufficient depth for insertion of a new tie. Next, the blades are separated by clyinders 66, shown in phantom in FIG. 2, so that an open trench is created. Then the tie is dropped by releasing cylinder 122 so that the weight of the tie causes the tie and jaw clamp 118 to pivot clockwise about pivot 120 until the inner end of the tie hits the ballast. This would bring the tie to the position indicated generally at 166 in FIG. 2 where the inner end would be between the outboard wings of the blades and the outer end of the tie is held up. Note that point 120 is at the start of path 162.

Then the cylinders 114 will draw the boom in—pivot it about 110 — which will slide the tie into the open trench. As the boom pivots, follower 152 on potentiometer 150 will move over cam face 148 which, as explained above, changes the telescopic position of the boom so that point 120 will follow path 162. The initial leg of movement 168 is downward and inward, say, at something like 45°. The inner end of the tie is merely resting on the ballast and will be forced inwardly across the top of the ballast and under the near rail 116. The second leg of movement 170 may be considered to be generally horizontal with the inner end of the tie moving to and under the far rail 118. This path has the advantage that the initial entry angle of the tie under the near rail is inclined down which avoids any chance of a hangup on the rail base. If the inner end of the tie tends to ride up due to ballast being forced ahead and under it so that it might hit the far rail 118, the free rollers 72 spanning the blades or cofferdams will keep the tie down and, in effect, apply sufficient pressure on top of the tie so that it will not hit the base of the far rail. This brings the tie to its fully inserted position with about the same amount of sticking out on each side. But since the ties normally vary in length somewhat and the clamp and its related mechanism will always bring the near end of the ties to the same position, the far ends may well stick out different amounts.

The boom is now ready to be retracted. First, cylinder 122 is pressurized so that the jaw clamp will be held in an operative position. The weight of the jaw itself would cause it to pivot counterclockwise about 120 by gravity and it should be held in a generally horizontal position. The jaw is then opened by retracting piston 130. Then the boom is swung out, but it isn't necessary to take it all the way out to the broken-line position in FIG. 1. Rather, the boom is only moved part way out a distance sufficient to clear the side of the machine. At this point, cylinder 140 moves the mast and the boom forward, to the full-line position in FIG. 2. The boom has been telescoped in sufficiently by cylinder 132 so that the jaw clamp is at the level of new ties on top of the rails.

With the boom and mast forward and out of the way, cylinders 68 can raise the drop head from the broken-line to the full-line position in FIG. 2. When raised the blades can then be closed or brought together.

The operator then propels the machined forward and the propulsion system is tied into the kicker cylinders 90 so that forward movement automatically swings the kickers 86 out. When the bumper 94 either hits or pushes the tie ahead of it, the operator then can stop at the next position with the drop head aligned with the area where he wants to insert a tie. When propulsion stops, the arrangement is such that the kicker cylinders 90 automatically retract to bring the kickers in, thus automatically centering the next tie. Then, cylinders 114 pivot the boom in so that the clamp jaw 118 slips over the end of the new tie. The ends of the kickers may be arranged to receive a removable extension 172 which may be put on the side opposite the working side. As the jaw clamp moves in to grasp one end of the tie, the extension 172 will resist or back up the other end. Then the jaw is closed by cylinder 128 so that the new tie is grasped fully and firmly by the jaw. At this point, the jaw tilt can be unlocked meaning that cylinder 122 may be de-energized since the weight of the tie itself will control the pivoted position of the jaw clamp. The jaw and boom are then pivoted out which pulls the new tie out to the left in FIG. 1. Cylinder 122 then pivots the jaw clamp 118 counterclockwise pivoting the new tie up generally to position 164 in FIG. 1. Then cylinder 140 slides the mast and boom structure rearwardly, with the new tie in hand and flipped up in the position 164 in FIG. 1, to the broken-line position of FIG. 2 laterally opposite the drop head, which, at this point, is up. At the same time, cylinder 132 will extend the telescopic boom so that the jaw itself will be at crib level. The cycle is complete and the machine is now back in its starting position.

Railroad maintenance requires that worn-out ties be replaced in an otherwise satisfactory stretch of roadbed. There are other machines that can destroy and/or remove these ties and the present invention is directed to a machine and method for scarifying a tie bed and for inserting a new tie under the rails of the track all of which can be operated or performed by one man.

The scarifying or drop head arrangement 24 is initially positioned over the spot where a new tie is to be inserted. The hydraulic circuit, explained hereinafter, preferably operates so that the drop head may be substantially freely dropped. In many instances the ballast will be sufficiently loose so that a single drop of the drop head will be sufficient to place the blades at the proper depth within the ballast. However, at other times two or three drops may be required. In any event, after the scarifier or drop head has been dropped, the piston and cylinder assemblies 66 are actuated to move the blades apart to form an open trench. Preferably the blades are moved just far enough so that the trench is of the size and shape to receive a tie. The tie inserting mechanism 26 then performs the sequence of steps referred to herein to insert the tie after which the drop head may be raised. Then the sequence starts over.

Figure 9:
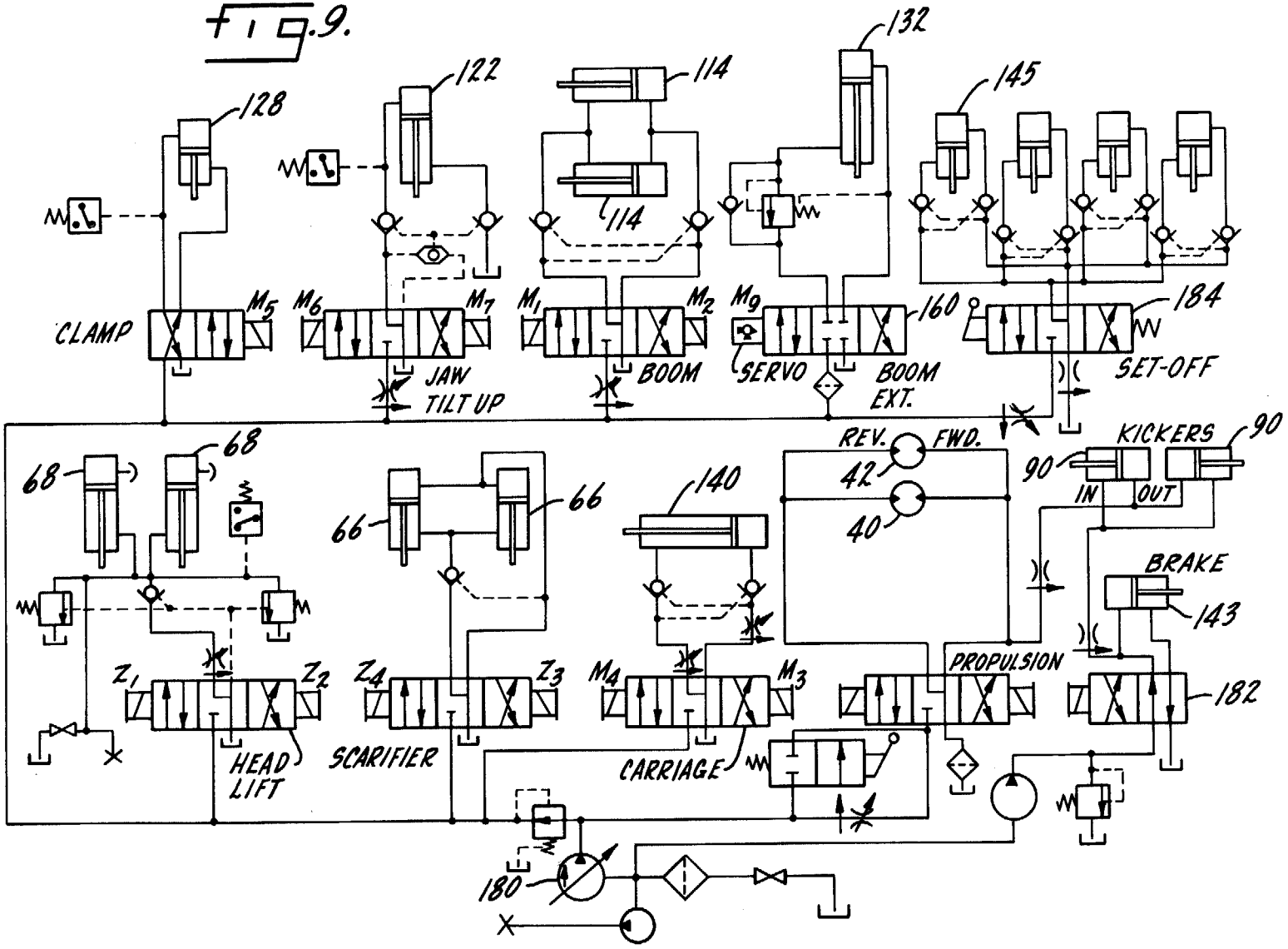
FIG. 9 is a schematic of a hydraulic circuit.
Figure 10A:
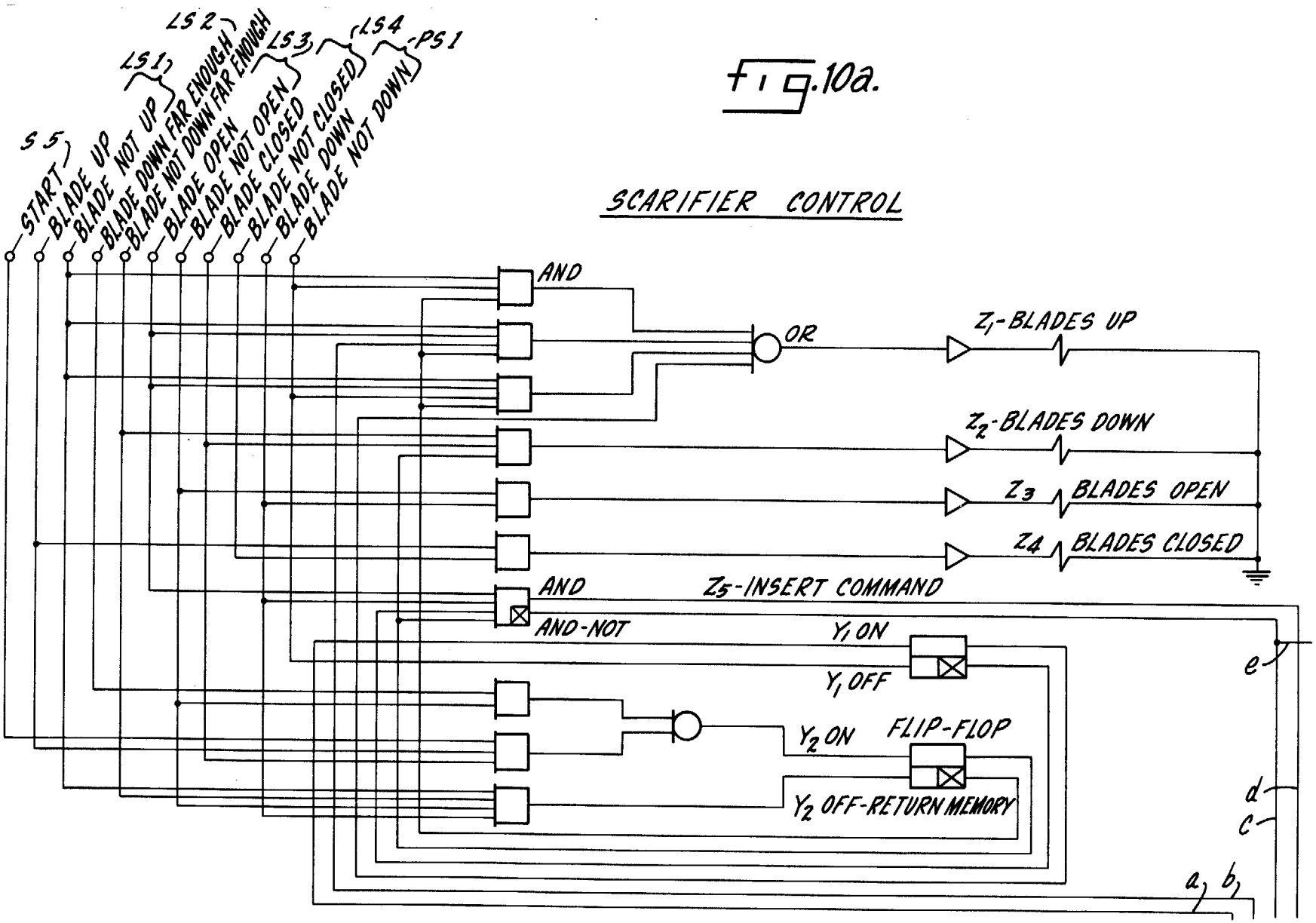
FIGS. 10*a–e* are a logic system and wiring diagram.

In FIG. 9 the hydraulic circuit has been shown with the various cylinders carrying the same numerals as in FIGS. 1–8. An electric circuit is provided which is represented in FIGS. 10*a–e* by a wiring or logic diagram. The diagram shown in FIGS. 10*a–e* is basically composed of two main components. First, the scarifier control which is shown in FIG. 10*a* and second, the insertion control which is shown in FIGS. 10*b–e*. In FIG. 10*a* along the top edge on the left are a series of switches, most of which are microswitches with one being a pressure sensitive switch and another being a start button. A similar row of micro and pressure-sensitive switches are shown along the top left in FIG. 10*b*. It is thought not necessary to trace all of the individual wires and connections since the symbols used are conventional English logic symbols and the various lines and connections are self-explanatory. For example, in FIG. 10*a* a series of "and" gates are shown in a row with one "and, and-not" with a similar series of "and" gates in FIGS. 10*b–e*. Also, "or" gates are shown as well as flip-flops. Running through the buttons or microswitches or pressure switches along the top left in FIG. 10*a*, "start" designated S-5 may be a simple manually-operated start button with one in cab 28 and another in cab 30. Next, "blade up" and "blade not up" is a three-contact limit switch designated LS-1 and indicated in FIG. 2 as being located generally on top of the slides or guide rails for the drop head. The next limit switch LS-2 "blade down far enough" and "blade not down far enough" is indicated as being positioned along the bottom of the guide channels for the drop head in FIG. 2. The next limit switch LS-3 "blade open" or "blade not open" may be located as indicated generally in FIG. 2 on the slides or supports 63 for the blades. The same is true of the next limit switch LS-4 indicating "blade closed" and "blade not closed" as shown in FIG. 2. The next designated switch PS-1 is a pressure sensitive switch "blade down" or "blade not down" which would be a pressure-sensitive switch located on the piston side of the cylinder 68 indicated generally in FIG. 4.

Figure 10B:
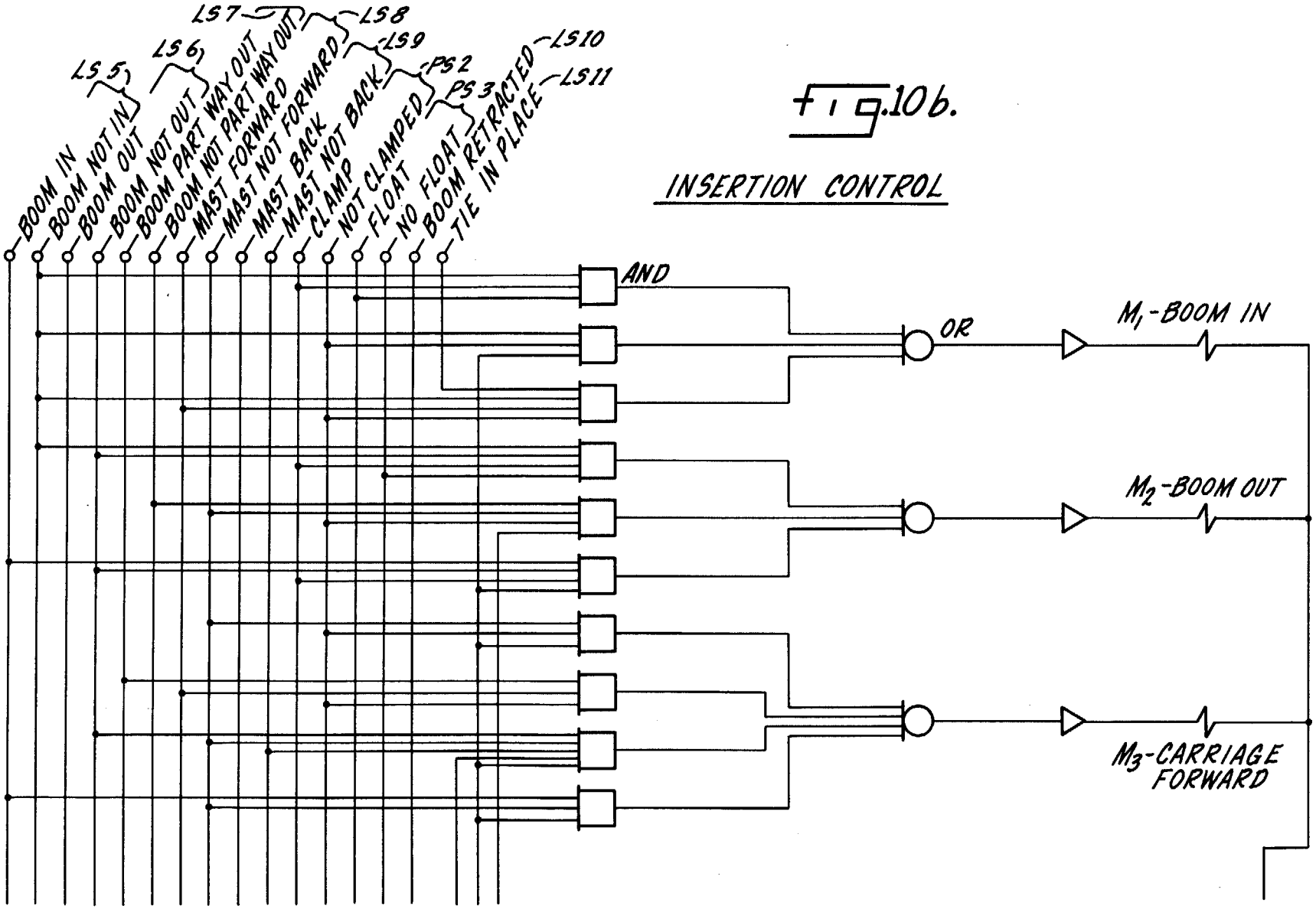

Running through the switches shown along the top left side in FIG. 10*b*, the first switch LS-5 "boom in" and "boom not in" would be a limit switch located on cylinders 114 indicated generally in FIG. 1. Limit switch LS-6 "boom out" or "boom not out" would be similarly located on cylinders 114 as indicated generally in FIG. 1. The next limit switch LS-7 "boom part way out" or "boom not part way out" would also be located on cylinders 114 to indicate that the boom, without a tie in the claw 118 would be part way out after a tie had been inserted so that the mast and boom could be moved forward. Next, limit switch LS-8 "mast forward" or "mast not forward" would be located on the rail 76, generally in a position indicated on FIG. 3. Next, LS-9 "mast back" or "mast not back" is a similar limit switch located on the rail 76 toward the rear end thereof as indicated generally in FIG. 3. PS-2 "clamp" or "not clamped" would be a pressure sensitive switch in clamp cylinder 128 as indicated generally in FIG. 1. The next pressure-sensitive switch PS-3 "float" or "no float" would be located in cylinder 122, as shown generally in FIG. 5, which controls the pivoted position of the claw 118. Limit switch LS-10, a single contact unit "boom retracted" would be positioned on one cylinder 132, as indicated generally in FIGS. 5 and 6 to indicate when the boom is fully telescoped in. LS-11, a singe contact limit switch "tie in place" would be a switch on the front of bumper 94, as shown in FIG. 1, which would be contacted by a new tie in front of the machine on top of the rails to energize the tie insertion mechanism.

In the hydraulic circuit in FIG. 9 the main pump 180, shown at the bottom, may be driven by a gasoline engine or otherwise. A series of solenoid control valves are shown across the bottom and are appropriately designated "Head Lift," "Scarifier," and "Carriage" with each valve controlling the appropriate cylinders for its function. For example, the "Head Lift" valve controls lift cylinders 68, the "Scarifier" valve controls the cylinders 66 on top of the drop head, and so forth. Each valve has a solenoid at each end. In the case of the "Head Lift" valve, the solenoids are designated Z-1 and Z-2. The "Scarifier" valve has solenoids Z-3 and Z-4 and the "carriage" valve has solenoids M-3 and M-4.

The same is true of the series of valves shown on the second line and designated "Clamp," "Jaw Tilt Up," "Boom," and "Boom Ext" each with solenoids on each end, appropriately marked, for controlling it. The "Clamp" valve controls cylinder 128 for clamping the jaw 118, the "Jaw Tilt Up" valve controls cylinder 122 which controls the pivoted position of the jaw shown in FIG. 5 and so forth.

Figure 10C:
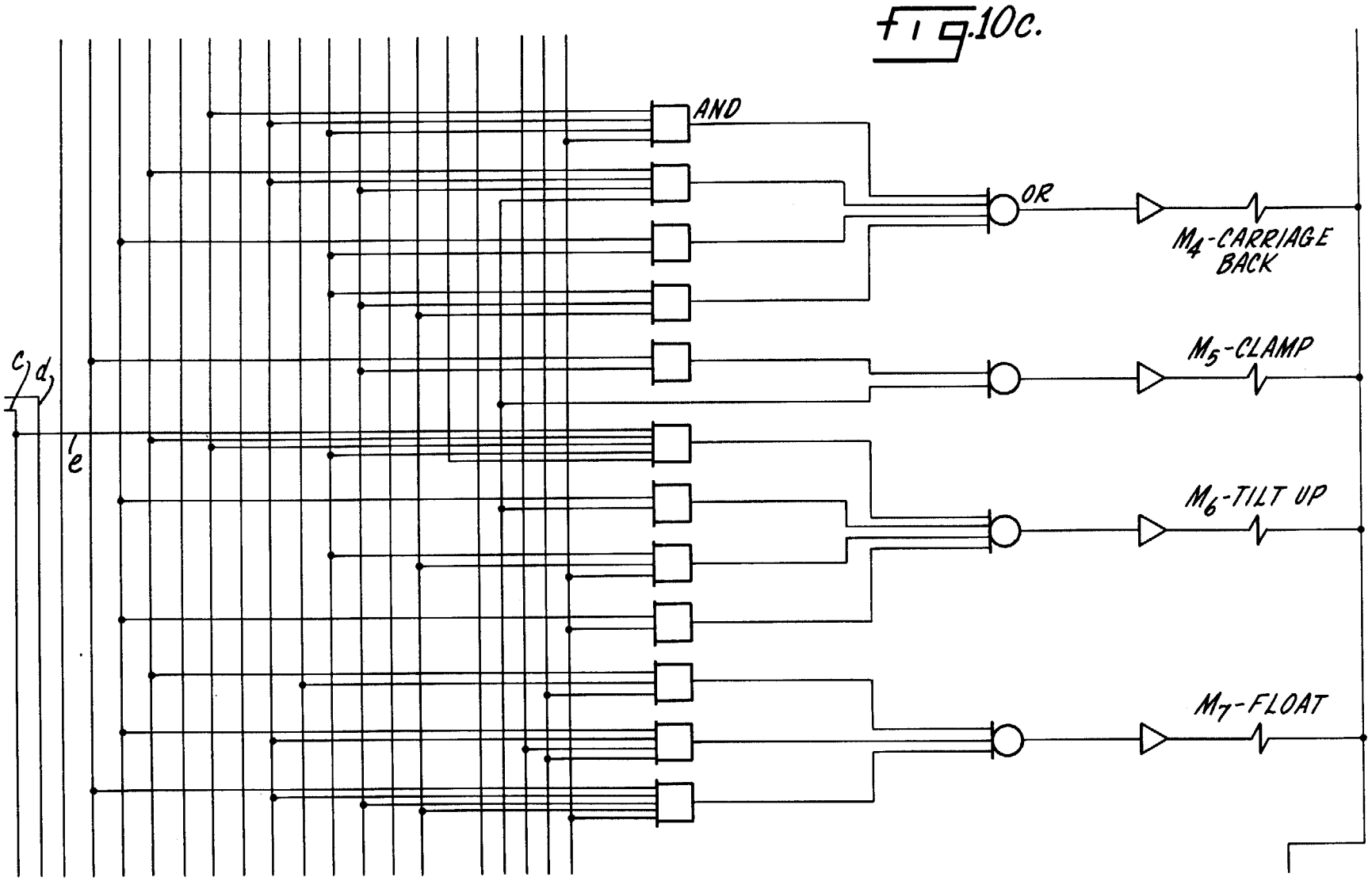
Figure 10D:
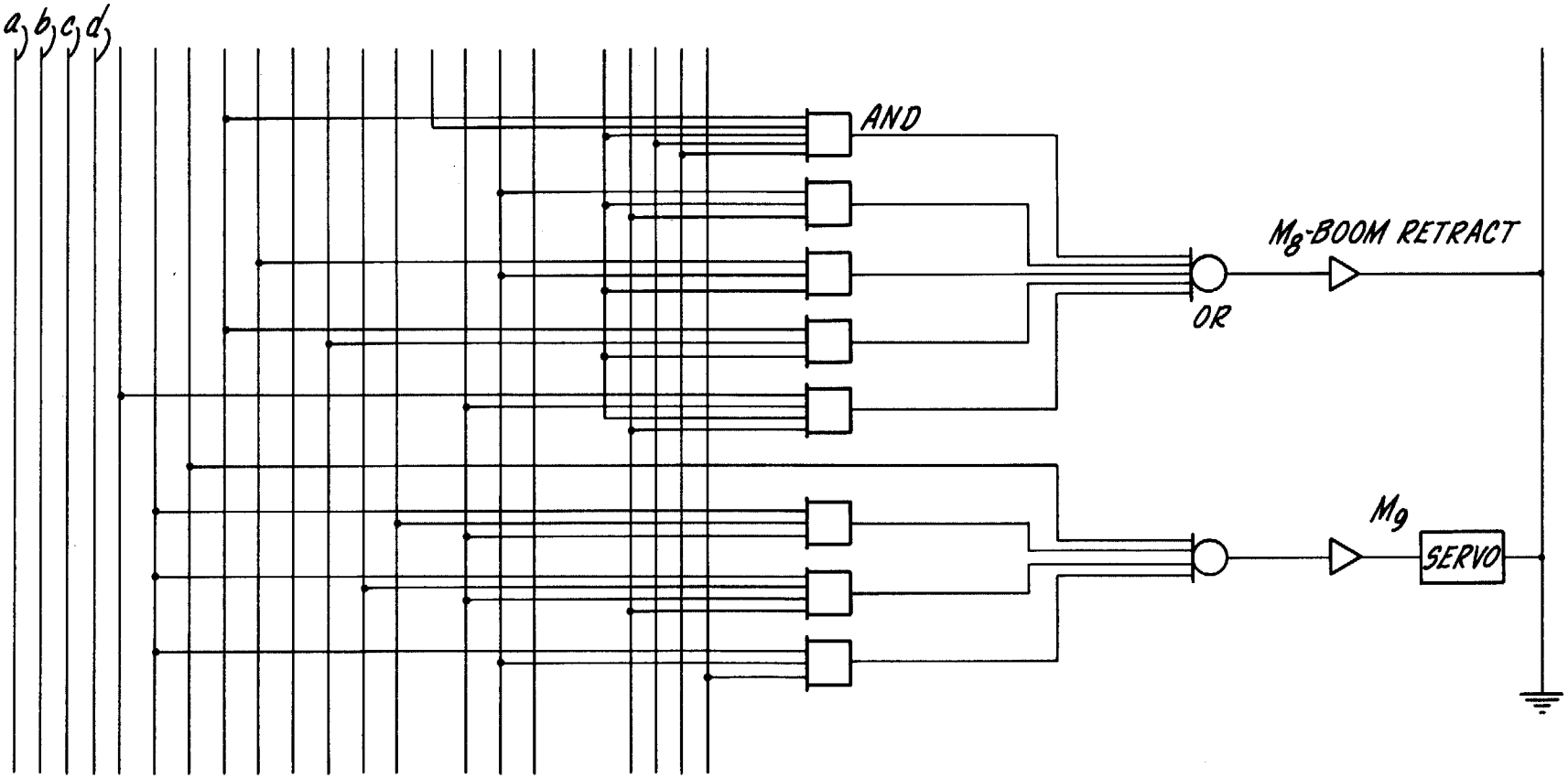

The various solenoids M-1 through M-9 are shown in FIGS. 10*b–d* with solenoids Z-1 through Z-4 shown in FIG. 10*a*.

In FIG. 9 the main propulsion valve "Propulsion" may be considered manual and is solenoid operated by direct manual switches on the instrument panel in the cab. This valve controls the two hydraulic motors 40 and 42 which drive the wheels. To the right of the propulsion wheel in FIG. 9 is shown the Kickers 90 which, it will be noted, are tied into the propulsion unit so that when the motors 40 and 42 are turning forward, the "kickers" will be out. A brake control valve 182 which also may be manually operated from a foot pedal which controls a solenoid on this valve, may be tied into the kicker cylinders 90 so that when the brakes are applied, the kickers automatically move in to properly position a tie. The set off cylinders 145 are shown in the upper right in FIG. 9, and are controlled by a manual valve 184. FIG. 9 also has the usual pressure relief valves and pilot-operated check valves but even though these have been shown, they have not been explained in detail since they may be conventional.

Figure 10E:
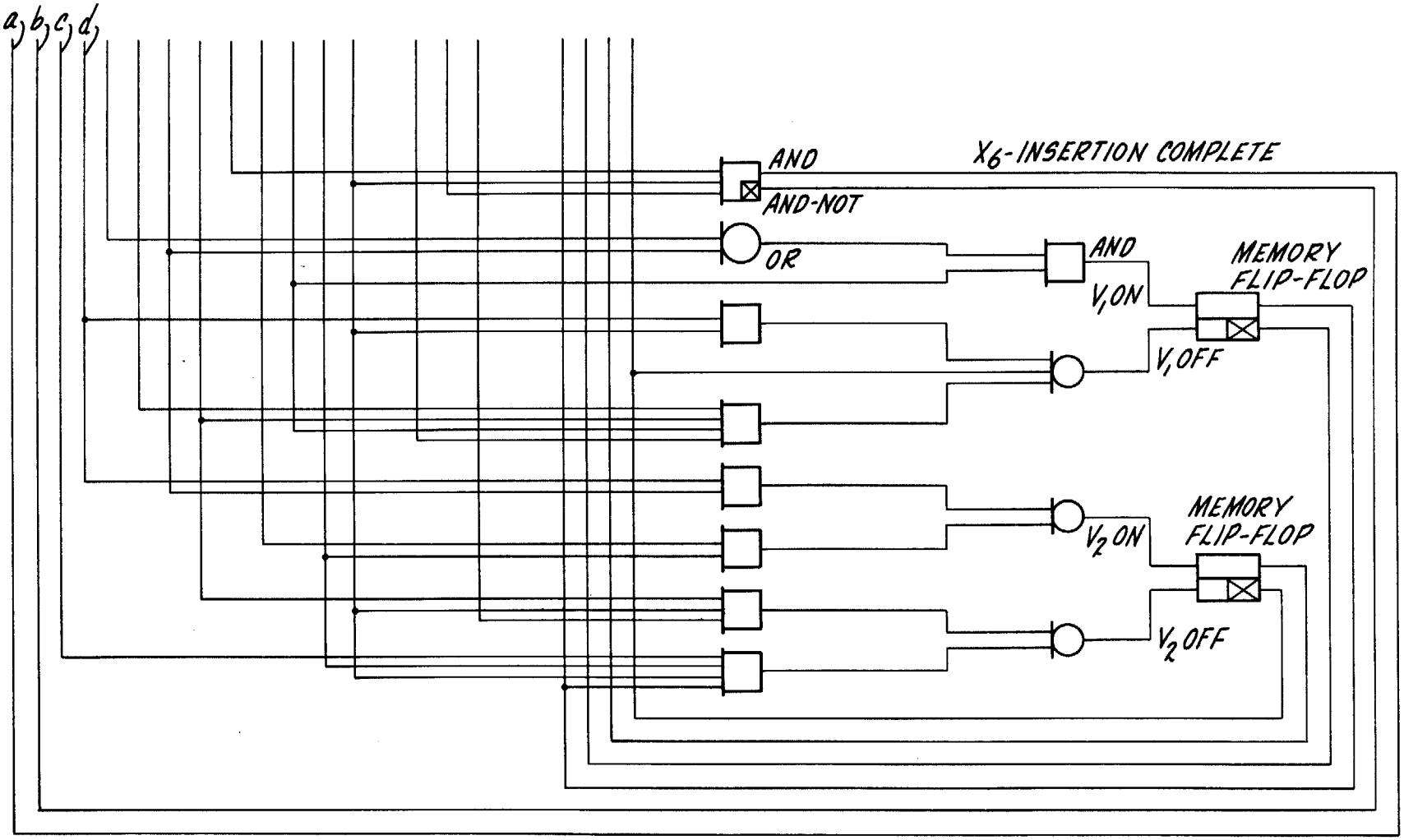

The scarifier control and insertion control in FIGS. 10*a–e* are tied together by lines designated "Insert Command" Z-5 in FIG. 10*a* and "Insertion Complete" X-6 in FIG. 10*e*, indicated on the various sheets or drawings FIGS. 10*a–e* so as to tie those four sheets together. For purposes of clarity, the "Insertion Complete" lines have been designted "*a*" and "*b*" on the upper left in FIG. 10*e*, on the left in FIG. 10*d*, and on the lower right in FIG. 10*a* to tie these drawings together. The "Insertion Complete" X-6 lines do not appear in FIG. 10*c*. In a similar manner, the "Insert Command" Z-5 lines have been designated "*c*" and "*d*" on the lower right in FIG. 10*a*, on the left in FIG. 10*c*, on the left in FIG. 10*d*, and on the upper left in FIG. 10*e*, with the cross connection *e* being shown in both FIGS. 10*a* and 10*c*. The other lines flow directly from FIG. 10*b* through FIGS. 10*c* and *d* into FIG. 10*e* and are not thought to need labeling.

The general sequence of operations is as follows:

The operator would, by eye, position the machine over the appropriate spot so that the drop head will be lined up at the point where he wants to insert a new tie. A new tie is positioned in the clamp 118 with the mast and boom in the rear laterally opposite the drop head, in the dotted line position in FIG. 2. The tie will be firmly grasped by cylinder 128 with its inner end tilted up in the position 164 of FIG. 1. The operator manually depresses the start button S-5 which allows the drop head and blade assemblies to fall freely into the ballast. The blades or cofferdams are supposed to penetrate the ballast to a predetermined extent. After the drop, the circuit will automatically energize cylinders 66 to open the blades. If limit switch LS-2 indicates that the blades have not penetrated far enough, the drop head will be automatically raised again to the "ready" position and the blades will close. The operator then may either drop the blades again or reposition the machine in the event that the blades had struck an obstacle on the first drop.

One advantage of automatically opening the blades at the bottom of a drop, even though they may not have penetrated the ballast far enough, is that some if not most of the side excavation will already have been done when the blades automatically retract, close and drop again to the right depth. But the automatic retract may be used without automatic separation at the bottom of the drop. This is to say that the blades could stay together and be automatically raised again if they do not penetrate far enough with separation occurring only if they have penetrated far enough.

If the blades have penetrated to the required or predetermined depth, an "insert" command will be sent from the "scarifier control" to the "insertion control" through the insert command connection Z-5. This starts the insertion cycle. The tie is tilted down so that the inner end of the tie is between the blades, in the 166 position of FIG. 1. The boom is pulled in along path 162 with the cam face 148 controlling the path of point 120. When the tie is fully inserted, the boom is swung out to its part-way-out position and slightly retracted so that the clamp 118 will be raised to the above-rail level.

The boom and mast 108 are automatically moved forward by cylinder 140 to a position laterally opposite the pickup position in front of the machine as shown in full lines at 26 in FIG. 2. X-6 "Insertion Complete" then signals the scarifier control which automatically raises the drop head and blade assembly and closes the blades which brings it to the full-line position in FIG. 2. At the same time, the tie insertion mechanism, upon reaching its forward position, will automatically move in and grasp the next tie, in position 96 in FIG. 2, if the tie is in position against the bumber 94 in contact with limit switch LS-11. If the tie is not in place, the boom will remain out, until the machine is advanced by the operator along the track and contacts the tie at which point the boom will automatically swing in and the sequence starts over. After a tie is clamped, the boom swings out automatically and the tie is tilted up to the 164 position of FIG. 1. The insertion assembly then is moved rearwardly by cylinder 140 back to the "ready for insertion" position where it stops. Thus the cycle is complete.

Instead of merely dropping the blades, they may be forced into the ballast. For example, we might grab the rails or ties with the clamps attached to the frame and push the blade into the ballast. But a free drop is preferred and has proven to be quite satisfactory and does not have a tendency to raise or hump the rails.

The blades have been shown as extending on both sides of the rails, but it should be understood that the portion of the blades outside of either one rail or the other may be eliminated. We prefer that the center portion of the blades between the rails always be used. Also, the portion of the blades outside of the rails on the side where the tie is inserted should be used. But the portion of the blades outside of the rail on the other side, beyond the far rail, may not be necessary since the leading blunt face of the tie may merely push the ballast ahead of it on that side.

Having the blades extend down somewhat in the center portion between the rails, such as shown in FIG. 1, is considered desirable. This makes the trench a little deeper than is necessary between the rails. Since the ballast directly under the near rail will not be touched by the blade, the entering tie will push ahead of it the ballast from under the near rail. By having the trench between the rails a little deeper than actually necessary, this ballast will have a place to go without causing the front end of the tie to ride up. The entire operation will be followed by a tamper or other machine for fully packing the ballast around the newly-inserted tie.

The blades or blade-like diggers are not necessarily limited to the precise shape shown. Preferably the blades will be continuous or solid, but in some applications the bottom surface thereof may be formed with closely-spaced projections or teeth, much like the end of a rake. In general, however, it is desirable to have the blades substantially solid or continuous and as shown, the blades are slidably moved to the open position. The invention should also include an arrangement in which the blades are pivoted or otherwise moved into the open position.

While both blades have been shown as being moved apart or seperated by cylinders 66, it should be understood that one of the blades could be stationary and the other movable. While the arrangement has been described as being hydraulically operated, it should be understood that certain aspects of the invention could be air-operated or other. Also, one end of the blades may be funnel-shaped to assist in guiding the tie in, although this has not been shown and is not considered necessary. These extensions, which would be on one side, may be pivoted so that they could swing up to reduce their length during traveling. Also, the blades may be adjustable mounted so they can be raised and lowered to accommodate different rail heights and tie depths, although this has not been shown in the drawings. If found necessary, a hook arrangement may be included to anchor the machine to the far rail so as to stabilize the machine on the rails against the reaction thrust of the tie inserter, although this is not considered necessary.

Some of the main advantages of the machine and method are that, first, it can be operated and performed by one man, is quite rapid in operation and can keep up with other auxiliary equipment, and also, the machine can be used to insert ties beneath railroad track on a selected or spot basis which does not disturb the existing ballast or disturbs it the least amount. This is because the trench formed by the blades is as close to the sides of the tie as possible, the blades themselves restraining or holding back the walls of the trench while a new tie is being inserted. The cofferdams or blades, in addition to holding back the ballast, also guide or properly channel the new tie into a quite accurate position so the new tie is prevented from skewing or cocking under the rails. Also, the depth of the trench can be quite accurately controlled so that the new tie has to be raised a minimum amount during spiking. Also a minimum of tamping is required. The operator only needs to position the machine properly over the place where he wants to insert a new tie and depress the " start" button. Then the machine will operate automatically. The drop head automatically falls until the blades reach the proper depth. At that point they will automatically open. If the blades have not gone deep enough, the head will automatically be raised which allows the operator to drop them again or to move the machine either forward or backward. When the blades do penetrate the ballast far enough, they automatically separate to just the right distance so that a tie can be inserted. At this point, the tie insertion mechanism will automatically insert the tie according to the pre-programmed path which causes a minimum of ballast disturbance. When insertion is complete, the drop head is automatically raised and the blades are closed, the tie insertion mechanism automatically withdraws and moves back to the front of the machine to grab a new tie, if one is in place. When a new tie hits the bumper 94 on the front, the tie insertion mechanism will automatically grab it and bring it to the "ready" position 164 in FIG. 1.

The bumpers on the front of the machine automatically position the tie so that the tie insertion mechanism won't miss. The bumpers are tied into the propulsion and brake circuit so that they are automatically moved out when the machine is under propulsion, and automatically move in to center a tie when the brakes are applied.

Although the invention has been described and shown and several alternate forms suggested, it should be realized that there are many modifications, substitutions and alterations within the scope of the invention.

We claim:

1. A method of inserting new ties under the rails or railroad track, including the steps of initially laying the new ties on top of the rails, grasping the new ties, one at a time, by one end only, drawing the tie laterally to one side of the rails until the free end of the tie is laterally outside of the rails, lowering at least the free inner end of the tie until it is generally aligned under the rails, inserting the tie laterally inwardly under the rails, and performing the drawing, lowering and inserting steps while grasping and supporting the tie during such steps only by the said one end thereof.

2. The method of claim 1 further characterized in that the step of lowering at least the free end of the tie until it is generally aligned under the rails includes pivoting the inner end of the tie downwardly about the grasped outer end.

3. The method of claim 1 further characterized in that the step of inserting the tie under the rails includes forcing the free end of the tie under the rails in a lateral motion and, at the same time, lowering the grasped outer end of the tie so that the tie performs a compound motion while it is being inserted.

4. The method of claim 1 further characterized by and including the step of initially positioning each tie laterally on top of the rails, before it is grasped, applying a force on either one end or the other so that each tie, as it is grasped, is in the same position laterally across the rails.

5. The method of claim 1 further characterized by and including the step of initially forming a trenchlike opening under the rails into which the tie is inserted.

6. The method of claim 1 further characterized by and including the steps of creating a trench in the ballast under the rails at the point of desired insertion of the new tie, lowering the inner end of the tie while in its position laterally to one side of the rails until the inner end is opposite the trench by pivoting the tie generally about its outer end, and simultaneously thereafter lowering and moving the outer end laterally inwardly during the insertion step so that the outer end of the tie follows a planned coordinate path during insertion, with the tie being in an inclined position at the start of insertion and in a generally horizontal position after the inner end of the tie has moved under the near rail.

7. A method of inserting new ties beneath the rails of railroad track, including the steps of creating a trench in the ballast under the rails at the point of desired insertion of the new tie, placing new ties on top of the rails in longitudinally-spaced relation to the trench, grasping a new tie on top of the rails and moving it laterally until it is outside the rails, moving the new tie longitudinally, while holding it outside the rails until the inner end of the tie is generally opposite the trench, and moving the new tie laterally inwardly into the trench under the rails until it is fully inserted.

8. The method of claim 7 further characterized by and including the step of lowering the inner end of the tie while in its position laterally to one side of the rails until the inner end is opposite the trench by pivoting the tie generally about its outer end, and simultaneously lowering and moving the outer end laterally inwardly during the inserting step so that the outer end of the tie follows a planned coordinate path during insertion with the tie being in an inclined position at the start of insertion and in a generally horizontal position after the inner end of the tie has moved under the near rail.

9. A method of inserting a new tie under a railroad track in accordance with a desired path, including the steps of providing a cam face, profiling the cam face in accordance with the desired tie path, sensing the profile of the cam face and generating a signal therefrom, providing a power source for handling and inserting the tie, and controlling the power source by the thus generated signal to cause the tie to be inserted under the rails in accordance with the cam face profile.

10. The method of claim 9 further characterized in that the signal is electric and the power source is hydraulic.

11. A machine for inserting new ties under the rails of railroad track, a wheeled frame adapted to be moved along the track, a tie inserter on the frame for inserting new ties under the rails, including a jaw clamp positionable on one side of the frame for grasping and supporting new ties resting on top of the rails, one at a time, by only one end thereof, a boom connecting the jaw clamp to the frame, and power means on the frame for operating the boom and jaw clamp such that new ties will be picked up and supported only by the jaw clamp grasping only one end, will be moved laterally to one side, lowered and inserted laterally under the rails in the ballast.

12. The structure of claim 11 further characterized by and including means of the front of the frame for positioning new ties on top of the rails laterally so that each tie will be in approximately the same lateral position for the jaw clamp.

13. The structure of claim 11 further characterized by and including a scarifying mechanism in the middle of the frame constructed to form a trench in the ballast, the boom being mounted on a slide on the frame, and power means for moving the boom and slide longitudinally back and forth between the front of the machine and the scarifying means so that new ties can be picked up by the jaw clamp at the front, moved laterally to one side and rearwardly for insertion at the scarifying means.

14. In a machine for inserting new ties under the rails of railroad track, a wheeled frame adapted to be moved along the rails, a scarifier on the machine for creating a trench in the ballast under the rails at a particular location, and tie manipulating means on the machine for grasping new ties positioned on top of the rails ahead of the machine, one at a time, moving them rearwardly to the scarifier and inserting them under the rails in the tranch formed by the scarifier.

15. The structure of claim 14 further characterized in that the scarifier includes a pair of generally parallel horizontally movable transversely extending digger blades of a length greater than rail gauge, and means for causing said blades to move downwardly into the ballast and for moving said blades apart to form a trench in the ballast.

16. A machine for handling ties under the rails of railroad track, including a base, means for moving it along a railroad track, a boom pivotally mounted on the base and extending to one side of the track, the boom being extendable and having power means for extending and retracting it, means on the outer end of the boom for handling a tie, and an automatic control for the power means so that the amount of extension of the boom will be automatically coordinated to its pivoted position.

17. The structure of claim 16 further characterized in that the control for the boom and base includes a cam profile on one of them, a sensing device on the other adapted to sense the cam face in the various pivoted positions of the boom, and means for generating a signal from the sensing device to control the boom extension power means.

18. In a railroad tie bed scarifier, a frame movable along a railroad track, a pair of generally parallel blades extending transversely on the frame and mounted thereon adapted to be separated longitudinally by a distance sufficient to form a trench for insertion of a railroad tie and to be closed together, the blades being movable vertically between a raised position and a lowered position where they penetrate the ballast, and sensing means for automatically raising the blades so that they may be lowered again if they have not penetrated the ballast to a predetermined depth.

19. The structure of claim 18 further characterized by and including means for automatically separating the blades in their lowered position prior to their being raised again when they have penetrated the ballast to the predetermined depth.

20. In a railroad tie bed scarifier and inserter, a frame movable along a railroad track, a pair of generally parallel blades extending transversely on the frame and mounted thereon adapted to be separated longitudinally by a distance sufficient to form a trench for insertion of a railroad track tie and to be closed together, said blades being movable vertically between a raised position and a lowered position where they penetrate the ballast in their closed condition, insertion means on the frame for inserting a railroad tie under the rails between the separated blades, and sensing means for automatically energizing the insertion means when the blades have been separated in their lowered position.

21. The structure of claim 20 further characterized by and including means responsive to the insertion means for automatically raising the blades and closing them when the insertion means has completed the insertion of a new tie.

22. In a railroad tie bed scarifier and inserter, a frame movable along a railroad track, scarifying means on the frame for forming a trench in the ballast under the rails movable between raised and lowered positions on the frame, insertion means on the frame for inserting a railroad tie under the rails in the thus formed trench, and sensing means responsive to the scarifying means for automatically energizing the insertion means so as to insert a tie when a trench has been formed by the scarifying means.

23. In a railroad tie bed scarifier and inserter, a frame movable along a railroad track, scarifying means on the frame for forming a trench in the ballast under the rails movable between raised and lowered positions on the frame, insertion means on the frame for inserting a railroad tie under the rails in the thus formed trench, and means responsive to the insertion means for raising the scarifying means when the insertion means have completed the insertion of a new tie.

24. In a railroad tie inserter, a frame movable along a railroad track, insertion means on the frame for inserting a railroad tie under the rails, and means responsive to the frame contacting a new tie positioned on top of the rails for automatically energizing the insertion means so that the new tie will be grasped and manipulated by the insertion means.

25. The structure of claim 24 further characterized by and including scarifying means on the frame for forming a trench in the ballast under the rails.

26. In a railroad tie bed scarifier and inserter machine, a frame movable along a railroad track, scarifying means on the frame for forming a trench in the ballast under the rails, insertion means on the frame for inserting a railroad tie under the rails in the thus formed trench, the insertion means being movable longitudinally on the frame between a forward position where it grasps and picks up a new tie positioned on top of the rails and a rearward position where it is aligned laterally with the trench formed by the scarifying means, and means responsive to the machine contacting a new tie positioned on top of the rails for automatically energizing the insertion means so that the new tie will be grasped by the insertion means, moved laterally to one side and then rearwardly until it is laterally aligned with the scarifying means ready for insertion.

27. A machine for inserting new ties in a railroad track, a frame movable along a railroad track, insertion means on the frame for grasping new ties, one at a time, positioned on top of the rails ahead of the machine and inserting them under the rails of the track, a propulsion system on the frame for moving the machine along the track from one location to another, tie positioning means on the front of the machine for positioning ties laterally across the rails, and means responsive to the propulsion system for automatically operating the tie positioning means when the propulsion system is de-energized.

28. In a scarifying machine for use on railroad track, a wheeled frame adapted to be moved along the rails of the track including an upper complete frame with two lower smaller longitudinally separated frames structurally interconnected to the complete frame to define an open bottom passageway extending laterally through the frame, a vertical guideway in the passageway including vertically disposed guide rails between the upper and lower frames, a drophead in the guideway adapted to be raised and freely dropped between the guide rails, and a pair of laterally disposed blades on the drophead adapted, when the drophead is dropped, to penetrate the ballast and to be separated longitudinally so as to form a trench in the ballast for thy insertion of a new tie.

29. The structure of claim 28 further characterized by and including two control stations on the frame, one on each side of the upper frame, so that the operator may be positioned on the side of the frame from which the new tie is being inserted to directly observe and control the operation.

30. The structure of claim 28 further characterized by and including at least two lift cylinders mounted on the upper complete frame, one on each side, and connected to the drophead so as to raise it for a free fall, and a universal joint mounting each of the cylinders on the upper complete frame to allow free movement of the drophead within the vertically disposed guide rails.

31. A method of handling a tie under railroad track in accordance with a desired path, including the steps of providing a cam face, profiling the cam face in accordance with the desired tie path, sensing the profile of the cam face and generating a signal therefrom, providing a power source for handling and moving the tie, and controlling the power source by the thus generated signal to cause the tie to be moved under the rails in accordance with the cam face profile.

32. In a railroad tie bed scarifier, a frame movable along a railroad track, a pair of generally parallel blades extending transversely on the frame and mounted thereon adapted to be separated longitudinally by a distance sufficient to form a trench for insertion of a railroad tie and to be closed together, the blades being movable vertically between a raised position and a lowered position where they penetrate the ballast, and control means for automatically separating the blades longitudinally in their lowered position so as to form a trench therebetween when they have penetrated the ballast a predetermined amount, including a circuit energized by the blades and responsive to the blades penetrating the ballast the predetermined amount for thereafter causing the blades to separate.

33. A method of inserting new ties beneath the rails of railroad track, including the steps of creating a trench in the ballast under the rails at the point of desired insertion of the new tie, placing new ties in longitudinally-spaced relation to the trench and over the rails, grasping a new tie over the rails and moving it laterally until it is outside the rails, moving the new tie longitudinally, while holding it outside the rails until the inner end of the tie is generally opposite the trench, and moving the new tie laterally inwardly into the trench under the rails until it is fully inserted.

34. In a railroad tie bed scarifier, a frame movable along a railroad track, a pair of generally parallel blades extending transversely on the frame and mounted thereon adapted to be separated longitudinally by a distance sufficient to form a trench for insertion of a railroad tie and to be closed together, the blades being movable vertically between a raised position and a lowered position where they penetrate the ballast, and sensing means for automatically separating the blades only when they are at a predetermined depth in the ballast.

35. A method of inserting new ties under the rails of railroad track, including the steps of initially positioning the new ties over the rails, creating an open trench by scarifying the ballast under the rails at the point of desired insertion of the new tie, grasping the new ties, one at a time, by one end, drawing the tie laterally to one side of the rails until the free inner end of the tie is laterally outside of the rails, lowering the inner end of the tie while in its position laterally to one side of the rails until the inner end is opposite the open trench by generally pivoting the tie about its outer end, and simultaneously thereafter lowering and moving the outer end laterally inwardly while inserting the inner end into the open trench so that the outer end of the tie follows a planned coordinate path during insertion, with the tie being in an inclined position at the start of insertion and in a generally horizontal position after the inner end of the tie has moved under the near rail.

* * * * *